US005771759A

United States Patent [19]

Warren

[11] Patent Number: 5,771,759

[45] Date of Patent: Jun. 30, 1998

[54] BEVERAGE CONTAINER EASY OPENER

[76] Inventor: John F. Warren, 618 Country Lake Dr., St. Peters, Mo. 63376

[21] Appl. No.: 680,014

[22] Filed: Jul. 15, 1996

[51] Int. Cl.[6] ..... B67B 7/44

[52] U.S. Cl. ..... 81/3.09; 81/3.27; 81/3.55; 81/3.57

[58] Field of Search ..... 81/3.09, 3.27, 81/3.55, 3.57

[56] References Cited

U.S. PATENT DOCUMENTS

| | | | |
|---|---|---|---|
| 1,355,330 | 10/1920 | Hall | 81/3.09 |
| 2,257,532 | 9/1941 | Perocco | 81/3.09 |
| 2,570,881 | 10/1951 | Stewart | 81/3.09 |
| 2,860,533 | 11/1958 | Lydon | 81/3.09 |
| 4,409,863 | 10/1983 | Anderson | 81/3.09 |
| 4,520,696 | 6/1985 | Wolze | 81/3.55 |
| 4,524,646 | 6/1985 | Kimberlin, Jr. | 81/3.55 |

*Primary Examiner*—D. S. Meislin
*Assistant Examiner*—Lee Wilson
*Attorney, Agent, or Firm*—Henry W. Cummings

[57] ABSTRACT

In accordance with the present invention, a can tab opener is provided, having a handle portion 12, and an upper outwardly extending first opening member 14. A second lower opening member 16 is provided, having a distial end 18 which is inclined downwardly. The upper member 14 includes a extension 15 which is inclined upwardly at its distal end portion, as indicated at 17. An optional feature is a bottle cap opener 20 which includes an arcuate cut-out portion 22 to engage a bottle cap and an opening 24 to facilitate storing the device at a convenient place.

5 Claims, 2 Drawing Sheets

BEVERAGE CONTAINER EASY OPENER

I. FIELD OF THE INVENTION

This invention relates to a device for opening containers such as contains soda and beer and have an outwardly extending tab to facilitate opening. An optional feature of the invention also includes at a second end, a device for opening bottle caps.

II. BACKGROUND OF THE INVENTION

U.S. Pat. No. 4,409,863 discloses a combined tab-top can opener which device at one end provides an arcuate portion for opening a bottle cap and at the second end a device for opening a can, having an upstanding tab. The can tab end includes a hollow portion which grasps the tab, and when the tool is rotated, the tab is open. However, this design requires an exact application to lift a pull-tab, because of its flattened tubular opening 18. The present invention has the ability to open pull tasb cans without the precision application required in the, 863 patent. Furthermore, the tubular configuration allows harboring of harmful contamints, and is less accessible to cleaning.

U.S. Pat. No. 4,309,921 discloses an opening for beverage cans of the type having an upwardly extending tab, including a depending plate portion 34, which also defines a slot for grasping the tab. However, this concept requires precise application, with the tab accurately threaded into the tab lifting element ie34. Precision application is not required in the present invention, and the present invention design provides greater leverage and finger accomodation then the '921 patent.

U.S. Pat. No. 4,373,246 discloses two embodiments for opening a container, having an opening tab. In FIG. 1, a slot is provided which engages the tab to facilitate opening. In another embodiment, illustrated in FIG. 2, in a lower member spaced from an upper member is utilized to grasp the tab. Both concepts require pressure on the pull tab for opening. In the present invention applies pressure to the can opening area, and tends to avoid breakage of the pull tab.

U.S. Pat. No. 4,391,167 discloses a tube for engaging the tab and a projection for gaining leverage as the tool is rotated to open the can. This concept also rwequires precision application, which is nort required in the present invention.

U.S. Pat. No. 2,860,533 discloses a device for opening cans, including an upper member 18, and a lower member 16, connected to a handle portion 14. However, the upper and lower member grasp the side of the container, rather than an upstanding tab, as the present invention is directed. The cans illustrated in this patent are used very little, if at all.

III. SUMMARY OF THE INVENTION

A. Objects of the Invention

One object of the present invention, is to provide a opener for cans having an upstanding tab.

Another object of the present invention, is to provide an opener for a can having an upstanding tab, which provides leverage, when the user opens the can.

Another object of the present invention, is to provide an can tab opener which can also open bottle caps.

B. Summary

In accordance with the present invention, a can tab opener is provided, having a handle portion 12, and an upper outwardly extending first opening member 14. A second lower opening member 16 is provided, having a distial end 18 which is inclined downwardly. The upper member 14 includes a extension 15 which is inclined upwardly at its distal end portion, as indicated at 17.

An optional feature is a bottle cap opener 20 which includes an arcuate cut-out portion 22 to engage a bottle cap and an opening 24 to facilitate storing the device at a convenient place.

IV. THE DRAWINGS

V. DESCRIPTION OF PREFERRED EMBODIMENTS

Figure 3:
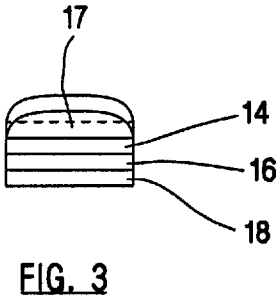
FIG. 3 is an end view, looking in the direction of the arrows, along the line 33, in FIG. 1, of the can tab opener of the present invention.
Figure 2:
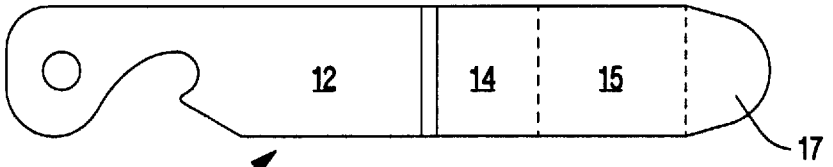
FIG. 2 is a top view of the can tab opener of the present invention.
Figure 1:
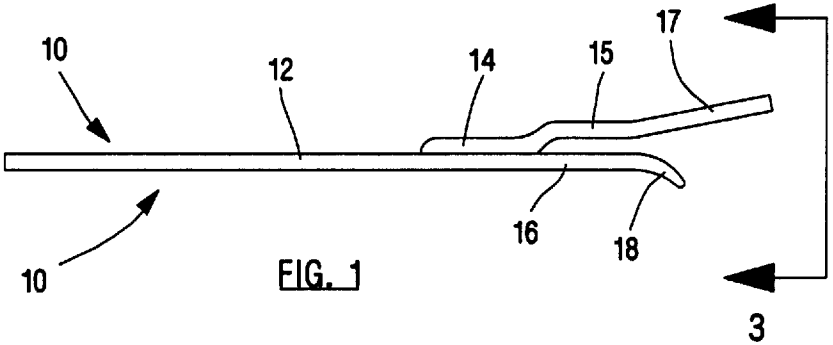
FIG. 1 is a side elevation view of the can tab opener of the present invention.
Figure 4:
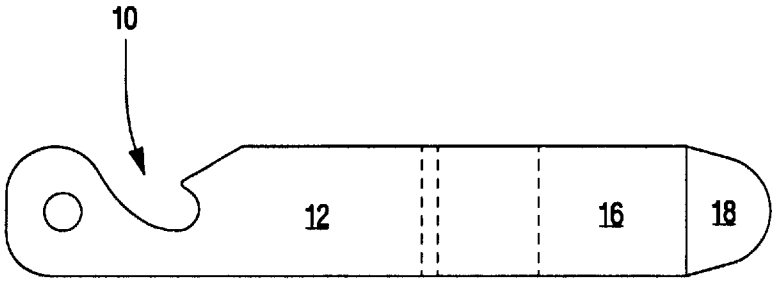
FIG. 4 is a bottom view of the can tab opener of the present invention.

1. In accordance with the present invention, the beverage container opener can, includes a body, or handle portion 12.

2. Integral with the body-handle portion, is an upper tab engagement member 14, which is integral with the handle portion 12 and includes an outwardly extending leg 15. The leg 15 has a distill end portion 17, which is formed at an angle to the portion 15. For example, an angle of 5 to 25 degrees is suitable.

3. The handle/body portion 12, extends below the member 14, and includes a portion 16, also adopted to grasp the tab, and has an outwardly extended distill end portion 18, which is also formed at an angle with respect to the portion 16. An angle of 10 to 40 degrees is a suitable angle range for this member.

4. An optional feature of the opener of the present invention, is to provide a bottle cap opener 20, at the opposite end of the handle or body portion 12.

5. The bottle cap opener includes a body portion 21, having an arcuate cut-out portion 22, to grasp the bottle cap and an opening 24 to provide a convenient way of storing the tool.

Figure 5:
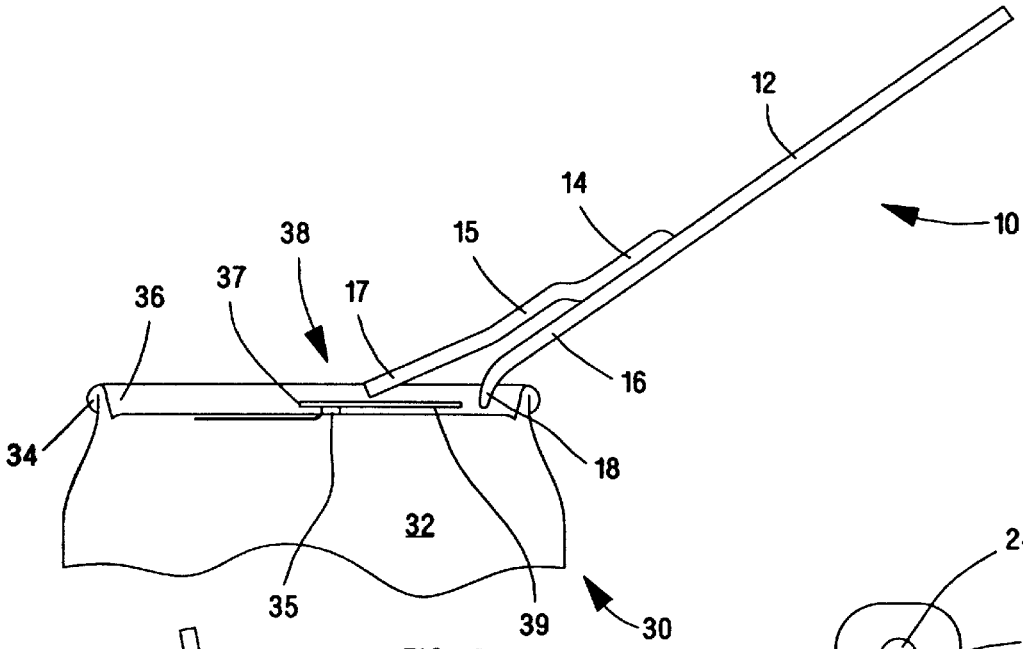
FIG. 5 is a side elevation view, illustrating the opener and a can having an outwardly extending tab, illustrating the initial approach of the opener to the container.
Figure 6:
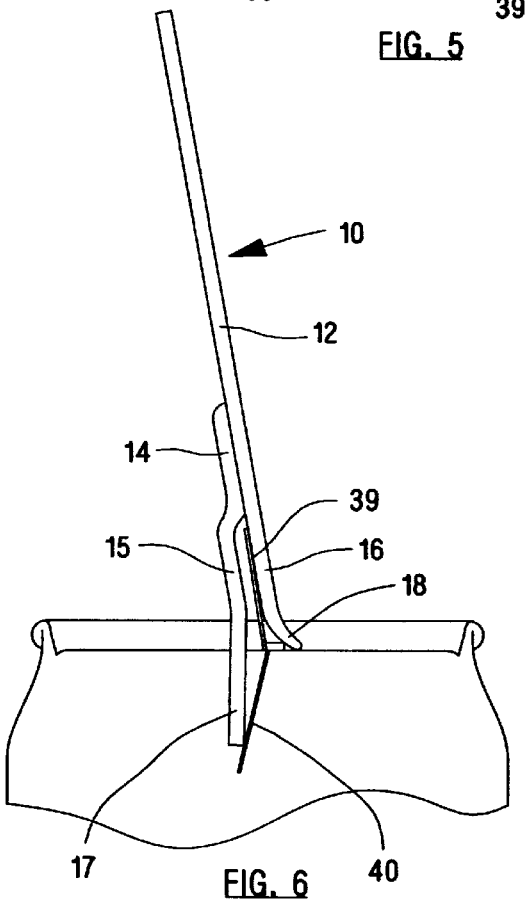
FIG. 6 is a view illustrating the leverage action which occurs in opening the can in according with the present invention.
Figure 7:
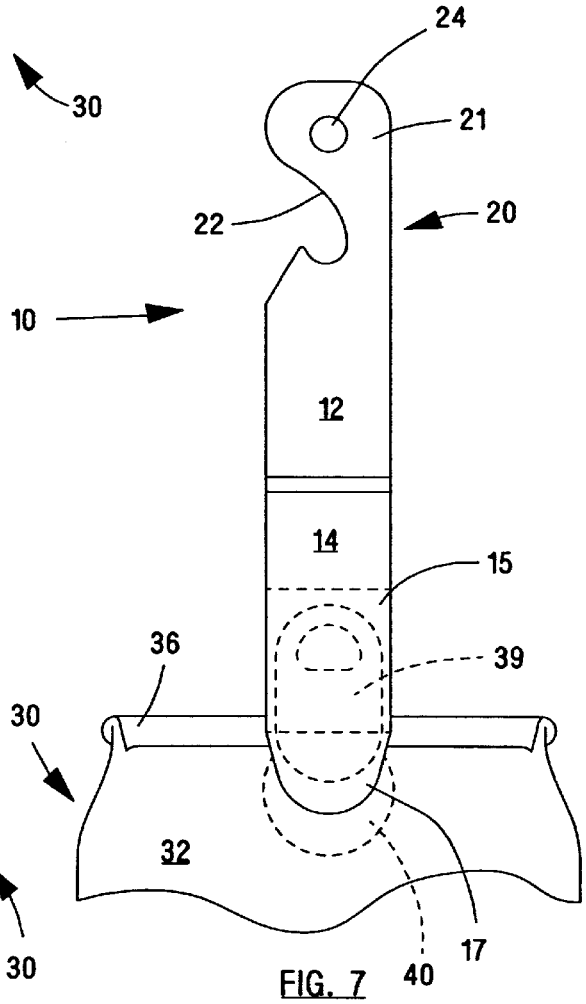
FIG. 7 illustrates the opener after the can has assumed the full open position.

6. As shown in FIGS. 5 through 7, a container 30, includes a body portion 32, having a top 34, which has opener therein 36. A tab 38 includes a first end 37 and a second end 39, and is mounted upon a support 35.

7. In use, the tool of the present invention, is grasp in the handle portion 12 and is moved towards the container top, such that the longer end 39 is located between the ends 17 and 18 of the tool 10.

8. As the tool is advanced further, the leg 16 engages the tab portion 39 with the arcuate portion 19 engaging initially the distill end of the tab portion 39. The leg 17 engages the upper surface of first tab portion 39 and then tab portion 37.

9. As shown in FIG. 6, after the handle is rotated, the tab is trapped between the legs 15 and 16, and the portion 18 provides leverage to facilitate opening the top portion 40 to the position shown in FIG. 6.

10. The present invention is an improvement over prior can tab openers in that the upper member 15 includes a first inclined portion 17, making an angle with the horizontal of 10 to 20 degrees, and the lower member 16, has a distill end 18, which is also inclined 10 to 30 degrees, to effectively grasp the tab as illustrated in FIGS. 5 and 6.

11. If desired, the opposite end of the tool may include a bottle opener 20, having a body portion 21 and an arcuate portion 22, to grasp the top of a bottle cap in a known manner. Optionally, an opening 24 may be provided to facilitate storing the tool.

12. The tool is preferably made of metal having a chemically inert oxide coating such as steel, including chromium-carbon steel, stainless steel, or aluminium alloy. It also may be made of strong, chemically inert, plastic.

What is claimed is:

1. A container opener for a can having a can upper surface having a tab generally parallel to said upper surface comprising:

a handle portion;

a first tab engagement member integral with said handle portion;

said first tab engagement member being spaced from said handle portion at a distal end;

said first tab engagement portion having a distal end portion making an angle with the horizontal, when said handle portion is in a horizontal position; and extending upwardly, to facilitate engagement with a first surface of a can tab;

said handle portion, having an extension, extending directly below said first tab engagement member to define a second tab engagement member when said handle portion is in said horizontal position;

said second tab engagement member, having a second inclined portion at its distal end, to facilitate engaging a second surface of said tab; whereby when a can, having an outwardly extending horizontal tab is contacted, said horizontal tab portion is engaged by both said first tab engagement member, and said second tab engagement member, and upon rotation of said handle portion, said tab is rotated upwardly and at the same time a can top portion is opened to enable a substance to be extracted from the container; said first tab engagement member having a distal end making an angle of from 10 to 20 degrees with the horizontal; said second can tab engagement member having a distal end portion makes an angle of from 10 to 30 degrees, with respect to the horizontal; said handle portion including at an opposite end, a bottle top opener.

2. The container opener according to claim 1, wherein said second tab engagement portion is an extension of said handle portion.

3. The container opener according to claim 2, wherein said first tab engagement portion is a separate member from said handle portion.

4. The container opener according to claim 1 wherein said bottle top opener includes an arcuate portion to engage a bottle top.

5. The container opener according to claim 4 wherein said bottle top opener includes an opening to facilitate storage.

* * * * *